US005082511A

United States Patent [19]

Farina et al.

[11] Patent Number: 5,082,511

[45] Date of Patent: Jan. 21, 1992

[54] PROTECTIVE COATING PROCESSES FOR ZINC COATED STEEL

[75] Inventors: Samuel T. Farina, Mt. Clemens; Karl A. Korinek, Troy, both of Mich.

[73] Assignee: Henkel Corporation, Ambler, Pa.

[21] Appl. No.: 404,236

[22] Filed: Sep. 7, 1989

[51] Int. Cl.[5] ..... C23C 22/36

[52] U.S. Cl. ..... 148/257; 148/262

[58] Field of Search ..... 148/257, 262

[56] References Cited

U.S. PATENT DOCUMENTS

| | | | |
|---|---|---|---|
| 2,835,617 | 5/1958 | Maurer | 148/6.15 |
| 3,109,757 | 11/1963 | Reinhold | 148/6.15 |
| 3,444,007 | 5/1969 | Maurer | 148/6.15 |
| 3,617,393 | 11/1971 | Nakagawa et al. | 148/6.15 Z |
| 3,681,148 | 8/1972 | Wagenknecht et al. | 148/6.15 Z |
| 3,961,992 | 6/1976 | Jahuke | 148/257 |
| 4,165,242 | 8/1979 | Kelly | 148/257 |
| 4,595,424 | 6/1986 | Hacias | 148/6.15 R |
| 4,596,607 | 6/1986 | Huff et al. | 148/6.15 Z |
| 4,713,121 | 12/1987 | Zurilla et al. | 428/472.3 |

OTHER PUBLICATIONS

EP 010659 4/84.

EP 0060716 9/82.

*Primary Examiner*—Sam Silverberg

*Attorney, Agent, or Firm*—Ernest G. Szoke; Wayne C. Jaeschke; Norvell E. Wisdom, Jr.

[57] ABSTRACT

The cold impact resistance and corrosion resistance of objects having a zinciferous metal surface successively coated with a zinc phosphate conversion coating and an organic surface coating can be improved by utilizing sufficient manganese ion in the solution used for zinc phosphating to assure the presence of at least 3% by weight manganese in the phosphate conversion coating layer formed. Sufficient phosphating to achieve good bonds to organic surface coatings can be accomplished in as little as 5 seconds.

20 Claims, No Drawings

PROTECTIVE COATING PROCESSES FOR ZINC COATED STEEL

FIELD OF THE INVENTION

The present invention relates to coating processes to protect zinc coated steel surfaces. "Zinc coated" is to be understood herein as including coatings with alloys that are predominantly zinc and are electrochemically active, as is zinc itself, and as including any coating method. The protective coatings formed according to the invention may combine an internal layer that is predominantly zinc phosphate with an external layer of an organic polymer. The invention is particularly useful when the external layer is deposited from a plastisol, especially when this external layer consists wholly or predominantly of poly(vinyl chloride), hereinafter "PVC".

STATEMENT OF RELATED ART

Zinc phosphating of active metal surfaces generally is well known in the art, as is subsequent coating with paints, lacquers, and other organic polymers. Some relevant specific references for zinc phosphating are given below.

In the prior art, most zinc phosphating has been applied to the surfaces of objects that already have the shape in which they will ultimately be used at the time of phosphating. Already known processes provide highly satisfactory zinc phosphate conversion coatings for such uses.

In many manufacturing operations, it is more convenient and economical to perform conversion coating, and subsequent final surface coating with a paint or similar type of protective coating, on "coil" stock that is later shaped into parts for actual use. It has been found, however, that when known types of zinc phosphating are applied to hot dipped galvanized steel ("HDG") and the phosphate coating formed is then covered with an organic polymer, the strength of the adhesive bond between the phosphate coating and the surface coating polymer provides insufficient cold impact resistance to permit substantial later reshaping of the coated metal without damaging the protective value of the coating. This is particularly true when the surface coating is applied from a plastisol, as predominantly PVC coatings usually are. Other types of pretreatment solutions give a superior base for the adhesion of plastisol coatings, but do not give as good a corrosion resistance as does zinc phosphate.

It is an object of this invention to provide a conversion coating for zinc surfaces that can serve as a highly effective substrate for subsequent coating with organic surface coatings to produce an object with both good corrosion resistance and good cold impact resistance. It is also an object of this invention to provide a zinc phosphating process that will provide uniform coatings at a sufficient speed to be practically useful on modern high speed coil coating lines.

U.S. Pat. No. 4,713,121 of Dec. 15, 1987 to Zurilla et al. teaches that the resistance of zinc phosphate conversion coatings to alkaline corrosion can be increased by controlling the proportions of zinc and of another divalent metal in the coating; one of the other divalent metals taught is manganese, and it is taught that when this is used together with zinc, the proportion of manganese in the solution for phosphating should be from 45 to 96, and preferably from 84 to 94, mole percent of the total of manganese and zinc. There is also a teaching of some specific phosphating solutions in which zinc, nickel, and manganese are all used together; these teachings describe relatively high concentrations of zinc, nickel, or both.

U.S. Pat. No. 4,596,607 of June 24, 1986 to Huff et al. teaches zinc phosphating baths also containing manganese and nickel, all containing nickel in a sufficiently large amount to constitute at least about 80 mole percent of the total of these three constituents.

U.S. Pat. No. 4,595,424 of June 17, 1986 to Hacias teaches that mixtures of zinc and manganese may be used in zinc phosphating, but does not teach any advantage from such mixtures; its primary teaching is that chloride concentration in the phosphating solution should be kept low to avoid white specking, and that if some chloride can not be avoided, white specking may still be avoided by keeping the fluoride to chloride ratio in the phosphating solution high enough.

U.S. Pat. No. 3,681,148 of Aug. 1, 1972 to Wagenknecht et al. teaches that in coating of zinc surfaces with zinc phosphating solutions, the presence of complex fluorides in the phosphating solution is advantageous.

U.S. Pat. No. 3,617,393 of Nov. 2, 1971 to Nakamura et al. teaches advantages from the presence of aluminum, arsenic, and/or fluoride ions in zinc phosphating solutions.

U.S. Pat. No. 3,109,757 of Nov. 5, 1963 to Reinhold teaches advantages from the presence of glycerophosphoric acids, their water soluble salts, and/or complex fluoride ions.

U.S. Pat. No. 2,835,617 of May 20, 1958 to Maurer teaches an advantage in phosphating baths from the use of zinc, manganese, or mixtures thereof, together with nickel ions and "soluble silicon" as exemplified by silicofluoride ions.

DESCRIPTION OF THE INVENTION

In this description, except in the working examples or where otherwise expressly indicated to the contrary, all numbers specifying amounts of materials or conditions of reaction or use are to be understood as modified by the term "about".

It has been found that superior cold impact resistance is achieved when epoxy resin, polyester, siliconized polyester, predominantly poly(vinylidene fluoride), and/or plastisol, especially predominantly PVC plastisol, surface coatings are applied over a predominantly zinc phosphate coating that contains at least 3% by weight of manganese in the phosphate coating. Such a level of manganese in the coating will generally result if the phosphating solution contains at least 0.5 grams per liter ("g/L") of $Mn^{+2}$.

Solutions used for a phosphating process according to this invention preferably have values for each component essentially as shown in Table 1 below, with the presence of chemically non-interfering counterions for all ionic constituents being assumed and the balance of the solution being water. It is also preferable that the solutions have from 10–40 points, more preferably 20–30 points, of total acid and/or from 0.8–5, more preferably from 1.5–4.0 points of free acid. The points of total acid are defined as the number of milliliters ("ml") of 0.1N NaOH solution required to titrate a 10 ml sample of the solution to a pH of 8.2, and the points of free acid are defined as the number of ml of 0.1N NaOH solution required to titrate a 10 ml sample of the solution to a pH of 3.8.

TABLE 1

PREFERABLE PHOSPHATING SOLUTIONS FOR THE INVENTION

| Constituent | Concentration Ranges Preferable | More Preferable |
|---|---|---|
| Total Phosphate | 5-20 g/L | 8[1]-15 g/L |
| $Zn^{+2}$ | 1.0-5.0 g/L | 1.5-3.5[2] g/L |
| $Mn^{+2}$ | 0.5-3.0 g/L | 1.0-2.0 g/L |
| $Ni^{+2}$ | 0.5-3.0 g/L | 1.0-2.0[3] g/L |
| Iron cations | 0.0-0.5 g/L | 0.0-0.2 g/L |
| Simple Fluoride | 0.0-1.0 g/L | 0.1-0.5[4] g/L |
| Complex Fluoride | 0.1-7.0 g/L | 1.0-5.0[5] g/L |
| "Accelerator" | 2-10 g/L | 3-7 g/L |

[1]Most preferably the content of Total Phosphate is at least 11 g/L.
[2]Most preferably the content of $Zn^{+2}$ is no more than 2.5 g/L.
[3]Most preferably the content of $Ni^{+2}$ is no more than 1.5 g/L.
[4]Most preferably the content of simple fluoride is no more than 0.3 g/L.
[5]Most preferably the content of complex fluoride is no more than 2.0 g/L.

In Table 1 and in the remainder of this description "Total Phosphate" means the sum of the stoichiometric equivalents as $PO_4^{-3}$ ion of phosphoric acid(s) and all phosphorous-containing ions produced by dissociation of phosphoric acid(s), including condensed phosphoric acid(s). "Iron cations" includes ferrous and ferric ions. "Accelerator" means any of the oxidizing substances known in the art to increase the rate of phosphating without harming the coatings formed; this term includes, but is not limited to, nitrate, nitrite, peroxide, p-nitrophenyl sulfonate, and p-nitrophenol. Most preferably, the accelerator is nitrate. "Simple fluoride" means the sum of the stoichiometric equivalents as $F^-$ of fluoride ion, hydrofluoric acid, and all the anions formed by association of fluoride ion and hydrofluoric acid. "Complex fluoride" includes all other anions containing fluoride. Preferably, the complex fluoride content of the solutions is selected from hexafluorosilicate, hexafluorotitanate, hexafluorozirconate, and tetrafluoroborate; more preferably, the entire complex fluoride content is hexafluorosilicate.

A special advantage of phosphating according to this invention is the ability to operate at high speeds and still achieve good quality results. Thus any phosphating process according to this invention preferably has a contact time of less than 20 seconds, while contact times not greater than 15, 10, and 5 seconds are increasingly more preferable.

The temperature and other processing conditions, except for the contact time, for a phosphating process according to this invention are usually the same as known in general in the art for zinc phosphating of zinc surfaces. The coating weight produced in the phosphating step is generally from 1-3 and preferably from 1.5 to 2.5 grams per square meter of surface coated ("$g/m^2$"). The phosphating coating may be followed, as is almost always preferable, by water rinsing and further conventional posttreatment contact with a material such as a chromate ion containing or chrome free resin containing solution or dispersion to improve corrosion resistance and adhesion of the coating. Also, the phosphate coating may be preceded, as is almost always preferable, by a conventional "activating" treatment, such as with dilute titanium phosphate, to improve the quality of phosphating achieved.

After a suitable phosphate coating and any desired post-treatment has been performed, conversion coating according to the invention can be advantageously followed by surface coating the surface with a conventional protective organic polymer based paint or similar material. A coating with a thickness of at least 10 microns ("μm") is preferred. Preferred examples of such protective surface coatings include two coat polyester coatings, epoxy primer followed by a polyester or siliconized polyester topcoat, epoxy primer followed by a topcoat of fluorocarbon polymers that is predominantly poly(vinylidene fluoride), and epoxy primer followed by a plastisol PVC topcoat. Most preferably, the organic surface coating includes PVC applied from a plastisol (i.e., a dispersion of finely divided PVC resin in a plasticizer). The materials and process conditions used for the polymer surface coating step are those known in the art. For example, an epoxy primer coat with a thickness of 3-4 micrometers ("μm") followed by a predominantly PVC plastisol topcoat with a thickness of 100-125 μm is especially preferred.

The relationship between the amount of manganese ion in a zinc phosphating bath and the amount of manganese found in a coating made with the bath is shown in Table 2.

TABLE 2

RELATION BETWEEN MANGANESE CONTENTS IN PHOSPHATING SOLUTION AND IN RESULTING COATING

| | | | | | | |
|---|---|---|---|---|---|---|
| Weight % Mn in Solution | 0.000 | 0.025 | 0.050 | 0.100 | 0.150 | 0.200 |
| Weight % Mn in Coating | 0.00 | 1.25 | 3.1 | 5.0 | 5.5 | >6 |

The amounts of manganese in the coatings shown in Table 2 Figure were determined by atomic absorption spectroscopy. The relationship between the amount of manganese in the phosphate coating and the resistance of subsequently PVC plastisol coated panels to cold impact is shown in Table 3.

TABLE 3

RELATIONSHIP BETWEEN AMOUNT OF MANGANESE IN COATING AND COLD IMPACT ADHESION

| | | | | | | | |
|---|---|---|---|---|---|---|---|
| Weight % Mn in Coating | 0 | 1 | 2 | 3 | 4 | 5 | 6 |
| Percent Peel | 50 | 25 | 5 | 0 | 0 | 0 | 0 |

Details of the cold impact test are described below in connection with the operating examples.

The practice of the invention may be further appreciated from the following operating examples and comparison examples.

EXAMPLES

General Procedure

Test panels were cut to dimensions of either 10×30 cm or 10×15 cm from hot dipped galvanized steel. The smaller panels were used to measure phosphating weights, while larger panels processed at the same time were continued through the entire processing sequence as described below.

1. Spray for 15 seconds at 66° C. with a conventional alkaline cleaner-degreaser.
2. Hot water rinse with 5 second spray.
3. Activating-conditioning rinse for 1-5 seconds at 49° C. with an aqueous solution (made with deionized water) containing a commercial titanium conditioning compound, Parcolene® AT, available from the Parker+Amchem Division of Henkel Corp., Madison Heights, Mich.

4. Spray for 5 seconds with a phosphating solution at 66° C. having the composition noted below for each specific example.
5. Spray rinse with cold water for 3-5 seconds.
6. Post treatment spray rinse for 2 seconds at 49° C., followed by squeegee removal of solution, with a conventional commercial product, Parcolene® 62, available from the Parker+Amchem Division of Henkel Corp., Madison Heights, Mich.
7. Air dry with clean compressed air.

After step 7, the smaller panels were weighed, then stripped in a 4% chromium trioxide solution at room temperature for 1.5 minutes, water rinsed, dried with clean compressed air, and weighed again to determine the phosphate coating weight by difference. For Comparative Examples 1-4 and Examples 1-4, the larger panels continued through the following steps:

8. Prime with Prime-A-Sol TM epoxy primer for use before PVC plastisol, a commercial product available from Hanna Chemical Coatings Corp., subsidiary of Reliance-Universal, Inc, with a Reliance Code of 368-25Y27-0261, to give a dry coating thickness of 2.5-3.7 μm; the peak metal temperature reached during coating was 199°-205° C.
9. Topcoat with Morton Barn Red REL Shield TM, a commercial predominantly PVC plastisol available from the same supplier as in step 9, with a Reliance Code of 373-35R27-0785, to give a dry coating thickness of 100-105 μm; the peak metal temperature reached during coating was 215°-225° C.

After completion of step 9, many of the test sheets were subjected to salt spray corrosion testing according to the method described in ASTM B117-61, after three of the four edges of the sheets had been coated with wax, the unwaxed edge had been sheared to leave it bare, and a straight scribe mark, sufficiently deep to penetrate the both layers of surface coating, had been made down the center of one side of the sheet. Other test sheets were subjected to cold impact testing according to the following method:

The painted panel is placed with the painted side down over a hole 25 mm in diameter in a large metal plate. An impact tester with a mass of 1.8 kilograms and a tip in the form of a sphere with a diameter of 25 mm was dropped onto the panel over the hole in the base plate from a height of 0.51 meter to produce a rounded depression in the test panel. The impacted test panel is then refrigerated at −18° C. for30 minutes. A nail with a diameter of about 3 mm and with spiral ridges similar to screw threads on its shank is then driven from the convex side of curved part of the impacted and refrigerated test panel entirely through the panel and shortly thereafter extracted from the panel. The percentage of the periphery of the hole thus formed from which the paint film can be lifted is recorded, as exemplified in Table 3. For most applications, only 0% failure of adhesion is good enough to be considered passing.

COMPARATIVE EXAMPLE 1

The phosphating solution for this example had the following ingredients:

Total Phosphate: 10.5 g/L
$Zn^{+2}$: 3.7 g/L
$Ni^{+2}$: 2.3 g/L
$Fe^{+3}$: 0.1 g/L
$NO_3^-$: 4.4 g/L
$SiF_6^{-2}$: 2.7 g/L
$F^-$: 0.1 g/L
Sodium carbonate—to adjust ratio between total acid points and free acid points to about 10.
Water: balance This solution had 30 points of total acid and 2.5-3.0 points of free acid. A coating weight of 2.1±0.2 g/m$^2$ was produced.

COMPARATIVE EXAMPLE 2

The phosphating solution contained the following ingredients:

Total Phosphate: 17.8 g/L
$Zn^{+2}$: 1.1 g/L
$Ni^{+2}$: 3.5 g/L
$NO_3^-$: 6.7 g/L
$SiF_6^{-2}$: 2.2 g/L
$F^-$: 0.2 g/L
$Na^+$: 2.5 g/L
$CO_3^{-2}$: 3.3 g/L
Water: balance This solution had 31 points of total acid and 1.5-2.5 points of free acid, and it produced coating weights of 1.7±0.1 g/m$^2$.

COMPARATIVE EXAMPLE 3

The phosphating solution for this example had the following ingredients:

Total Phosphate: 7.4 g/L
$Zn^{+2}$: 2.6 g/L
$Ni^{+2}$: 0.1 g/L
$NO_3^-$: 3.0 g/L
$SiF_6^{-2}$: 0.4 g/L
$F^-$: 0.1 g/L
$Fe^{+3}$: 2.5 g/L
Starch: 1 5 g/L
Water: balance This solution had 14.7 points of total acid and 4.2 points of free acid; the coating weight produced with it was about 2.1 g/m$^2$.

COMPARATIVE EXAMPLE 4 AND EXAMPLES 1-4

The phosphating solutions for these examples had the following composition:

Total Phosphate: 15 g/L
$Zn^{+2}$: 1.8 g/L
$Mn^{+2}$: variable—see below
$Ni^{+2}$: 1.2 g/L
$Fe^{+3}$: 0.1 g/L
$F^-$: 0.1 g/L
$NO_3^-$: 2.3 g/L
$SiF_6^{-2}$: 1.4 g/L
Water: balance The amounts of manganese ion were 0.25 g/L for Comparative Example 4, 0.50 g/L for Example 1, 1.0 g/L for Example 2, 1.5 g/L for Example 3, and 2.0 g/L for Example 4. All the solutions had a ratio of total acid points to free acid points within the range of 7 to 12, and all produced coating weights of 2.1±0.2 g/m$^2$.

All the examples above, and none of the comparative examples, produced painted sheets that passed the cold impact test described above, by having no loss of adhesion after cold impact.

The results of salt spray corrosion tests (according to ASTM B117-61) on sheets prepared according to Comparative Examples 1 and 4 and Examples 1-4 above are shown in Table 4. The numbers entered in this Table represent the distance, in sixteenths of an inch (=1.6 mm), away from the edge or scribe mark over which corrosion was noticeable. If the corroded zone was approximately uniform in width away from the edge or scribe mark, the entry shows the same two numbers on each side of a hyphen.

TABLE 4

EVALUATION OF EXTENT OF CORROSION AFTER SALT SPRAY TESTING

| Product from Example Number | | After Following Number of Hours Exposure: 168 | 336 | 504 | 672 |
|---|---|---|---|---|---|
| C-1 | Edge | $0-2^{s}$ | $0-2^{s}$ | $0-2^{3s}$ | $0-2^{4s}$ |
| | | $0-1^{s}$ | $0-2^{s}$ | $0-2^{3s}$ | $0-2^{4s}$ |
| | Scribe | N | N | VF8 | VF8 |
| | | N | N | N | $0-1^{s}$ |
| C-4 | Edge | $0-2^{s}$ | $0-1^{s}$ | $0-2^{3s}$ | 1-3 |
| | | N | N | $0-1^{s}$ | 0-1 |
| | Scribe | N | N | N | N |
| | | N | N | N | N |
| 1 | Edge | $0-1^{s}$ | 0-1 | $0-1^{2s}$ | $0-1^{2s}$ |
| | | N | $0-1^{s}$ | $0-2^{s}$ | $0-2^{s}$ |
| | Scribe | N | N | N | N |
| | | N | N | N | N |
| 2 | Edge | N | $0-1^{s}$ | $0-1^{s}$ | $0-1^{s}$ |
| | | N | N | N | N |
| | Scribe | N | N | N | N |
| | | N | N | N | N |
| 3 | Edge | N | N | N | N |
| | | N | N | N | N |
| | Scribe | N | N | N | N |
| | | N | N | N | N |
| 4 | Edge | N | N | N | N |
| | | N | N | N | N |
| | Scribe | N | N | N | N |
| | | N | N | N | N |

In the more common case, the width of the corrosion zone varies somewhat along the edge or scribe mark, and in such cases the minimum width is shown to the left of the hyphen and the maximum width to the right. If there are a few spots of corrosion in addition to the generally corroded zone, a superscript "s" is attached to the principal number to the right of the hyphen, with a superscript number showing the maximum size of such spots, if larger than one sixteenth of an inch. A principal entry of "N" indicates no observable corrosion or blistering, and thus is naturally the most preferable result. The entry "VF8" indicates that there was no observable corrosion, but there were blisters, no more than two blisters per square inch, with each blister no more than 0.8 millimeter in diameter. The two entries at each intersection in the Table represent duplicate samples.

The results in Table 4 show that somewhat more manganese in the phosphate coating is needed for maximum corrosion resistance than for adequate cold impact resistance. While 0.5 g/L of $Mn^{+2}$ in the phosphating solution, producing about 3% of Mn in the coating, is sufficient for full cold impact resistance, 1 g/L of $Mn^{+2}$ in the solution, producing about 4.6% of Mn in the coating, gives notably better resistance to edge corrosion after long term exposure to salt spray. For safety, a minimum of about 5% of Mn in the coating is most preferred for corrosion resistance.

The benefits of using zinc phosphating solutions containing sufficient manganese to produce at least 3% by weight of manganese in the phosphate coatings are not restricted to uses in which the phosphate coating is topped by a plastisol. The combination of increased corrosion resistance of and coating adhesion to objects made of painted galvanized steel is also observed when this type of zinc phosphate coating is used with other types of paint or other surface coating systems. This is illustrated in the following examples.

EXAMPLE 5 AND COMPARATIVE EXAMPLES 5-6

For these examples, process steps 1-7 were the same as already given above, but these steps were followed by a primer coat of Hanna Hydrasea TM II primer, Reliance Code WY9R13063, a polyester primer available from the same source as for step 8 above, to produce a thickness of about 2.0 μm after heating for 15-20 seconds at about 288° C. This primer was then followed by a topcoat of Hanna Morton Brown, Reliance Code SN 3Z16002, another polyester polymer coating available from the same source as in step 9, to produce a coating thickness of about 25 μm after heating for 25-30 seconds at about 288° C. The phosphating solutions used for step 4 were: The same as for Example 3 above for Example 5; the same as for Comparative Example 1 above for Comparative Example 5; and a solution according to the teachings of U.S. Pat. No. 3,444,007 for Comparative Example 6.

For the products of these experiments, the adhesion was measured by a T-bend test according to ASTM B3794. The best result in this test is scored as "0 T"; "1 T", "2 T", and "3 T" are progressively less demanding tests of adhesion. For most applications, either "0 T" or "1 T" is excellent, "2 T" is acceptable , while "3 T" or higher is marginal to unsatisfactory.

The corrosion resistance of the product from these experiments was also measured by salt spray as in Examples 1-4. The results of both corrosion and adhesion tests are shown in Table 5. The meaning of the scores for corrosion testing is the same as for Table 4.

TABLE 5

CORROSION AND ADHESION TEST RESULTS, EXAMPLES 5 AND C5-C6

| 1000 Hours Salt Spray | Example 5 | Comp. Ex. 5 | Comp. Ex. 6 |
|---|---|---|---|
| Edge | N | N | $0-1^{s}$ |
| Scribe | $0-1^{s}$ | $0-1^{s}$ | $0-2^{s}$ |
| T-Bend Adhesion | 1 T | 2 T | 0 T |

Comparative Example 5 provides excellent corrosion resistance but weaker adhesion. Comparative Example 6 provides excellent adhesion but less corrosion resistance than is desirable. Example 5 has the best combination of excellent ratings in both tests.

What is claimed is:

1. A process for protectively coating a surface of zinc coated or zinc alloy coated steel, said process comprising the steps of:

(A) contacting the predominantly zinc surface with a composition effective for activating said predominantly zinc surface for phosphating for a time effective for activating;

(B) forming over the surface activated in step (A), within a time not greater than 10 seconds, a phosphate conversion coating consisting predominantly of zinc phosphate and containing at least 3% by weight manganese, by contacting the surface activated in step (A) with a composition consisting essentially of water and:

Total Phosphate: 5-20 g/L
$Zn^{+2}$: 1.0-5.0 g/L
$Mn^{+2}$: 0.5-3.0 g/L
$Ni^{+2}$: 0.5-3.0 g/L
Iron cations: 0.0-0.5 g/L Simple Fluoride: 0.0–1 g/L
Complex Fluoride: 0.1–7 g/L
"Accelerator": 2–10 g/L (C) posttreating the conversion coating formed in step (B) by contact for a sufficient time with a posttreating composition; and (D) surface coating the posttreated conversion coated surface formed in step (C) with a coating at least 10 μm thick of material selected from the group consisting of polyester polymers, fluoropolymers that are predominantly poly(vinylidene fluoride), siliconized polyester polymers, copolymers of epoxy resins and hardeners for such resins, and materials that are predominantly poly(vinyl chloride) ("PVC").

2. A process according to claim 1, wherein the surface coating formed in step (D) is selected from the group consisting of (i) a combination of a polyester primer and a polyester topcoat and (ii) a combination of an epoxy resin copolymer primer and a polyester, a siliconized polyester, a fluoropolymer, or a predominantly PVC topcoat.

3. A process according to claim 2, wherein step (D) includes forming a film of fluid plastisol containing finely divided, predominantly PVC resin polymer and then heating to convert said film of fluid plastisol to said surface coating.

4. A process according to claim 3, wherein step (B) is accomplished by contacting the activated surface formed in step (A) with a composition consisting essentially of water and:

Total Phosphate: 8–15 g/L
$Zn^{+2}$: 1.5–3.5 g/L
$Mn^{+2}$: 1.0–2.0 g/L
$Ni^{+2}$: 1.0–2.0 g/L
Iron cations: 0.0–0.2 g/L
Simple Fluoride: 0.1–0.5 g/L
Complex Fluoride: 1.0–5.0 g/L
"Accelerator": 3–7 g/L.

5. A process according to claim 2, wherein step (B) is accomplished by contacting the activated surface formed in step (A) with a composition consisting essentially of water and:

Total Phosphate: 8–15 g/L
$Zn^{+2}$: 1.5–3.5 g/L
$Mn^{+2}$: 1.0–2.0 g/L
$Ni^{+2}$: 1.0–2.0 g/L
Iron cations: 0.0–0.2 g/L
Simple Fluoride: 0.1–0.5 g/L
Complex Fluoride: 1.0–5.0 g/L
"Accelerator": 3–7 g/L.

6. A process according to claim 1, wherein step (B) is accomplished by contacting the activated surface formed in step (A) with a composition consisting essentially of water and:

Total Phosphate: 8–15 g/L
$Zn^{+2}$: 1.5–3.5 g/L
$Mn^{+2}$: 1.0–2.0 g/L
$Ni^{+2}$: 1.0–2.0 g/L
Iron cations: 0.0–0.2 g/L
Simple Fluoride: 0.1–0.5 g/L
Complex Fluoride: 1.0–5.0 g/L
"Accelerator": 3–7 g/L.

7. A process according to claim 6, wherein step (B) produces a conversion coating with a weight of at least 1 $g/m^2$.

8. A process according to claim 4, wherein step (B) produces a conversion coating with a weight of at least 1 $g/m^2$.

9. A process according to claim 1, wherein step (B) produces a conversion coating with a weight of at least 1 $g/m^2$.

10. A process according to claim 8, wherein the conversion coating contains at least 5% by weight of manganese.

11. A process according to claim 1, wherein the conversion coating contains at least 5% by weight of manganese.

12. A process according to claim 4, wherein step (B) produces a conversion coating with a weight of at least 1 $g/m^2$.

13. A process according to claim 3, wherein step (B) produces a conversion coating with a weight of at least 1 $g/m^2$.

14. A process according to claim 2, wherein step (B) produces a conversion coating with a weight of at least 1 $g/m^2$.

15. A process according to claim 14, wherein the conversion coating contains at least 5% by weight of manganese.

16. A process according to claim 13, wherein the conversion coating contains at least 5% by weight of manganese.

17. A process according to claim 12, wherein the conversion coating contains at least 5% by weight of manganese.

18. A process according to claim 6, wherein the conversion coating contains at least 5% by weight of manganese.

19. A process according to claim 3, wherein the conversion coating contains at least 5% by weight of manganese.

20. A process according to claim 2, wherein the conversion coating contains at least 5% by weight of manganese.

* * * * *